United States Patent [19]

Stiles

[11] 4,219,961

[45] Sep. 2, 1980

[54] ARCH BLOCK BUILDING SYSTEM

[76] Inventor: Palmer Stiles, 635 Robin Way North, Satellite Beach, Fla. 32937

[21] Appl. No.: 945,419

[22] Filed: Sep. 25, 1978

[51] Int. Cl.[2] ..... E04B 1/32; A63H 33/06; E04C 1/24

[52] U.S. Cl. ..... 46/24 R; 52/89

[58] Field of Search ..... 46/24, 16, 17–23, 46/25; 52/86, 89, 88, 604, 608

[56] References Cited

U.S. PATENT DOCUMENTS

| | | | |
|---|---|---|---|
| 124,078 | 2/1872 | Ostrander | 46/24 |
| 1,038,996 | 9/1912 | Warner | 52/89 |
| 1,736,134 | 11/1929 | Rutherford | 46/24 |
| 2,158,943 | 5/1939 | Mamula | 52/89 |
| 2,295,352 | 9/1942 | MacDonald | 52/89 |
| 2,572,242 | 10/1951 | Burchett | 52/89 |

*Primary Examiner*—Russell R. Kinsey
*Assistant Examiner*—Michael J. Foycik, Jr.
*Attorney, Agent, or Firm*—Edward M. Livingston

[57] ABSTRACT

An arch block building system to simplify the building of arches in architectural construction and in toy block sets is provided by this invention. The arch block building system, which consists of only four basic shapes, simplifies the builder's construction of arches for use in bridges, entranceways and other structures, and provides an educational tool to teach the principles of arch construction through its use in toy block sets.

2 Claims, 5 Drawing Figures

ARCH BLOCK BUILDING SYSTEM

BACKGROUND OF THE INVENTION

Architectural construction and toy block building systems comprise the fields of invention to which this invention belongs. Since ancient times, the arch has been used in architectural construction to enable the builder to span distances greater than the length of an individual block and, at the same time, provide support to any weight over the arch.

The construction of an arch with blocks is usually somewhat time consuming and complex because the blocks must be individually formed or cut to shape. Although one basic shape can be used for the inner curve of the arch, the blocks which form around the curve must be custom fit. Because of these complexities, arches built entirely from blocks are not very common in architectural construction or toy block sets today.

SUMMARY OF THE INVENTION

This arch block building system starts with a basic unit, the double cube, a common example being the ordinary concrete block. The double cube together with three other shapes, a cube, an arch block and a filler block, can be used to form a complete arch. All four blocks are flat faced and shaped to eliminate the need to custom cut the blocks to make a curved arch.

An object of this arch block building system is to simplify and reduce the time and expense involved in the construction of arches. This arch block building system may be most useful in the construction industry for building decorative arches around windows or entranceways and small bridges over small streams or canals.

Another object of this invention is to serve as an educational tool to teach the principle of arch systems through toy block building sets.

DESCRIPTION OF THE PREFERRED EMBODIMENTS

Figure 1:
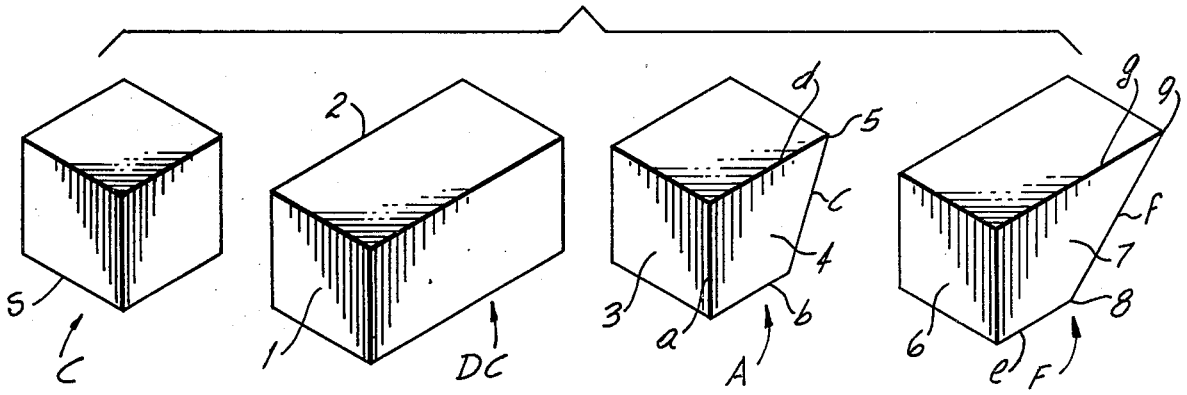
FIG. 1 is a perspective view of the four basic shapes of the arch block building system.

The four basic shapes of blocks of the arch block building system are shown in FIG. 1; these are the cube, C; the double cube, DC; the arch block, A; and the filler block, F; each hereinafter referred to by their alphabetical designations.

The blocks may be made from wood or molded plastic for use in toy block sets. For construction purposes the blocks may be made of concrete. A common example of the DC block is the ordinary concrete block which forms an eight (8) inch by sixteen (16) inch double cube after accounting for the mortar between each block. The remaining three basic blocks can be made in the same manner as the ordinary concrete block using only three separate molds.

The actual dimensions of the four blocks are important to the arch block building system. If the blocks are to be used for construction purposes then the dimensions set forth hereinafter will need to be adjusted downward slightly to account for mortar or other matter used to adhere the blocks together. The C block in FIG. 1 is merely a cube with four sides of equal dimensions. Hereinafter the letter "s" will be used, as it is in FIG. 1, to represent the length of one side of the C block. The DC block has the same dimensions as the C block at two ends, the front of these indicated by 1. The length of its four sides 2 between the two ends is just twice (2s) that of the cube.

The shape of the A block is determined by the dimensions of the two faces 3 and 4. Face 3 has the same dimensions as any side of the C block. However, the side of the A block indicated by numeral 4 has four sides of different dimensions. Side a has a dimension of s. However, side b measures 2x(tan 22.5°)s, side c measures (1/cos 22.5°)s and side d is equal to 3(tan 22.5°)s. The angle 5 formed by the intersection of sides c and d is equal to 67.5°. Although the underside of the A block is shown in FIG. 1 as being flat-faced, it may be curved starting from the front face 3 to the back of the underside so that when placed with the other blocks in constructions like those shown in FIGS. 2 and 3, the inner surface of the arch will form a curved arch.

The last of the four block shapes, the F block, has one face 6 with all sides measuring s in length. Face 7 of the F block provides the other dimensions necessary to form the F block. Side e has a length of (2–3tan 22.5°)s, while side f measures (1/sin 45°)s and side g is 3(1 – tan 22.5°)s in length. Sides e and f intersect at 8 to form an angle of 135°; whereas, sides f and g intersect to form angle 9 of 45°.

Thus, the major simplicity of the arch block building system is that it consists of only four block shapes. Once the dimension s of the C block is known, the remaining three blocks may be made to size accordingly. Thus, varying the s dimension will result in an arch block building system of any desired size.

Figure 2:
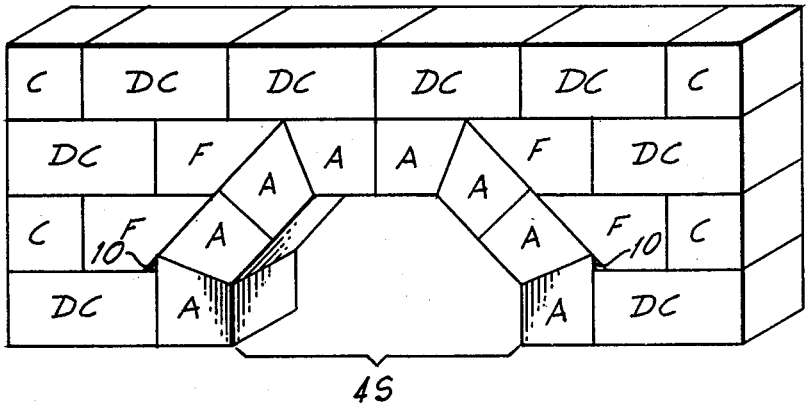
FIG. 2 is a perspective view of a bridge constructed with the four basic block shapes of FIG. 1.

FIGS. 2 through 5 illustrate the utilization of the four blocks of this invention. These four figures are just some of the applications of the arch block building system which are possible with this invention. The bridge in FIG. 2 is constructed by first positioning the lower DC blocks, and then building the arch with the A block between them. Once the arch is complete the F blocks are placed around the arch and the C and DC blocks are added to complete the bridge. The small spaces, 10, which remain after the bridge is built may be filled with mortar or other material as desired. A bridge constructed with the four block shapes in this manner has a span of 4s or twice the length of the DC block.

Figure 3:
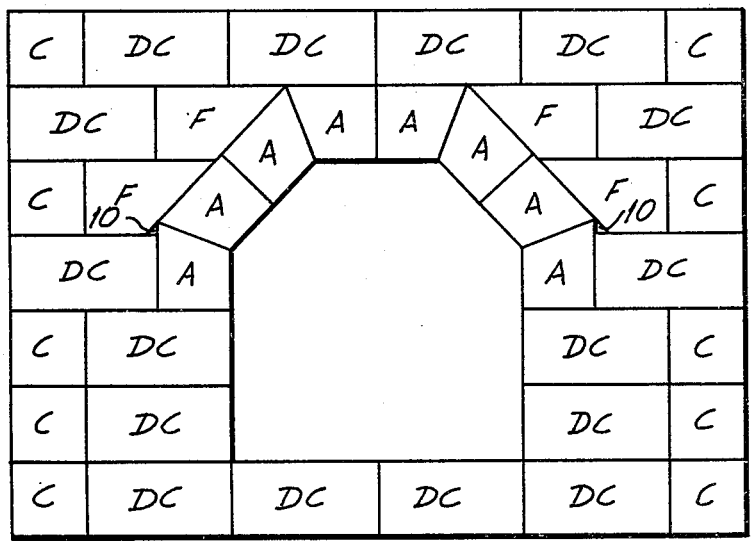
FIG. 3 is a frontal view of a window employing the arch block system.

FIG. 3 shows one type of window which can be constructed with the arch block system. This particular window is formed by simply adding DC and C blocks to the bottom of the formation of FIG. 2. Another shape of window, not shown in the drawings, may be constructed by substituting the formation of FIG. 2 for the DC and C blocks in FIG. 3 to yield a double arch-shaped window. Again the small spaces 10 may be filled with mortar, cut stone or glass for decorative purposes, or ignored for instructional and toy purposes.

Figure 4:
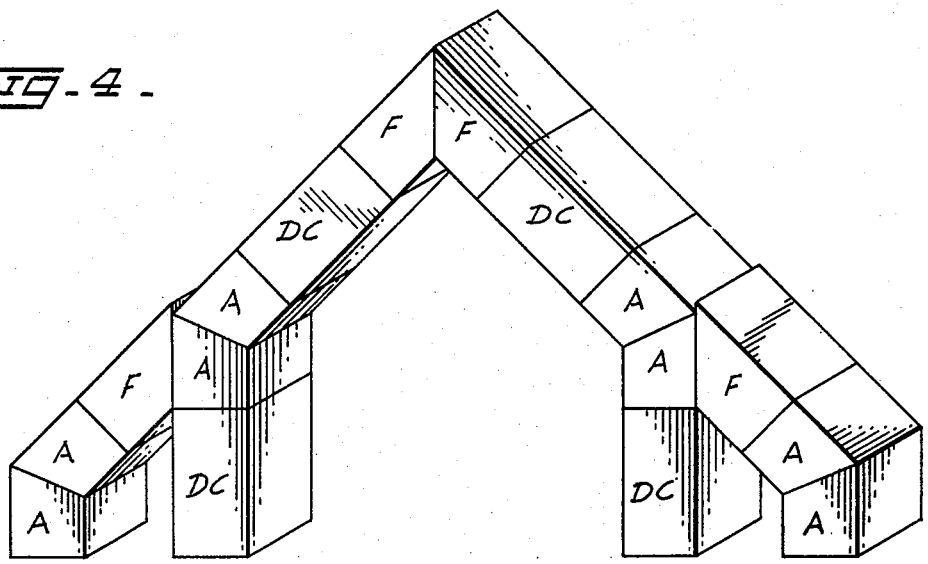
FIG. 4 is a perspective view of a pointed or gothic arch with flying buttress constructed from the arch block system.

The arch block building system can also be used to construct the pointed or gothic arch with flying buttress shown in FIG. 4. Each arch block except the C block is used to build the pointed arch. The buttress formed on each side by two A blocks and one F block give additional strength to the central arch between them. The pointed arch may be used as an architectural feature for building entrances in both the construction industry and in toy block sets.

Figure 5:
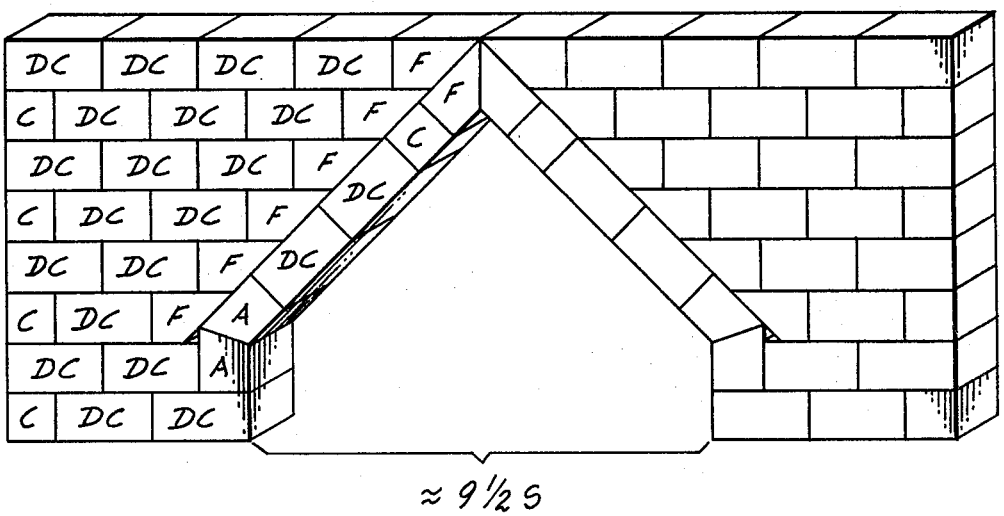
FIG. 5 is a perspective view of another type of bridge constructed with the arch block system.

The final arch block formation depicted in the drawings is the bridge in FIG. 5. This bridge constructed with the blocks has a span of approximately 9 and one-half (9½)s, which will allow it to be used over wider entrances or passageways than the bridge in FIG. 2.

The preceding description has set forth the four basic block shapes of this invention and some of the preferred embodiments of the invention as shown in FIGS. 2 through 5. This invention embodies the concept of using arch blocks which are flat faced, rather than curve faced, a concept which simplifies the building of the basic arch for decorative and teaching purposes.

While the drawings illustrate a particular embodiment of the invention and suggest various modes of utilization, the present invention is not limited to the drawings but also comprises any modifications within the scope of the appended claims.

Having thus described my invention, I claim:

1. An arch block building system to simplify the building of arched bridges, windows, entrances and other arch systems in the construction industry and in toy block kits, comprised of four basic block shapes as follows:

a. a cube-shaped block having sides with the same dimensions;

b. a second block twice the length of said cube-shaped block;

c. a third block having flat surfaces, the dimensions of which are based on the dimensions of said cube-shaped block with a side cut at an angle of 67.5 degrees;

d. a fourth block having flat surfaces, the dimensions of which are based on the dimensions of said cube-shaped block with a side cut at an angle of 45 degrees.

2. The arch block building system in claim 1 with said third block having a curved surface on its smallest face.

* * * * *